US007946040B2

(12) United States Patent
Sugishita

(10) Patent No.: US 7,946,040 B2
(45) **Date of Patent: *May 24, 2011**

(54) CHAINSAW

(75) Inventor: Yuu Sugishita, Kawagoe (JP)

(73) Assignee: Husqvarna Zenoah Co., Ltd., Saitama (JP)

( * ) Notice: Subject to any disclaimer, the term of this patent is extended or adjusted under 35 U.S.C. 154(b) by 304 days.

This patent is subject to a terminal disclaimer.

(21) Appl. No.: 11/920,454

(22) PCT Filed: Nov. 15, 2006

(86) PCT No.: PCT/JP2006/322717

§ 371 (c)(1),
(2), (4) Date: Nov. 15, 2007

(87) PCT Pub. No.: WO2007/058189

PCT Pub. Date: May 24, 2007

(65) Prior Publication Data

US 2009/0100688 A1 Apr. 23, 2009

(30) Foreign Application Priority Data

Nov. 15, 2005 (JP) ..... 2005-329637

(51) Int. Cl.
*B27B 17/02* (2006.01)

(52) U.S. Cl. ..... 30/383; 30/381

(58) Field of Classification Search ..... 30/381–387
See application file for complete search history.

(56) References Cited

U.S. PATENT DOCUMENTS

| | | | |
|---|---|---|---|
| 2,610,627 | A | 9/1952 | Watt et al. |
| 3,122,171 | A | 2/1964 | Britton et al. |
| 3,858,615 | A | 1/1975 | Weigl |
| 3,891,007 | A | 6/1975 | Kleykamp |
| 4,328,770 | A | 5/1982 | Hale |
| 4,362,187 | A | 12/1982 | Harris et al. |
| 4,727,651 | A | 3/1988 | Nakajima |
| 4,799,287 | A | 1/1989 | Belanger et al. |
| 4,809,502 | A | 3/1989 | Iida et al. |
| 4,872,308 | A | 10/1989 | Nagai et al. |
| 4,964,217 | A | 10/1990 | Siede et al. |
| 5,018,492 | A | 5/1991 | Wolf et al. |

(Continued)

FOREIGN PATENT DOCUMENTS

| | | | |
|---|---|---|---|
| CN | 2698539 | Y | 5/2005 |

(Continued)

OTHER PUBLICATIONS

International Preliminary Report on Patentability, Chapter I of the Patent Cooperation Treaty, and Written Opinion for PCT/JP2006/322717, dated May 20, 2008. 4 sheets.

*Primary Examiner* — Stephen Choi
(74) *Attorney, Agent, or Firm* — Holtz, Holtz, Goodman & Chick, PC

(57) ABSTRACT

A chainsaw includes: a body case 20 in which an engine for driving the chainsaw is accommodated; and a top handle 41 provided on an upper side of the body case 20. A fuel tank 7 for storing fuel of the engine is integrally provided to the top handle 41. A carburetor 6 is also provided to the top handle 41. The fuel tank 7 is disposed near the carburetor 6.

4 Claims, 5 Drawing Sheets

U.S. PATENT DOCUMENTS

| | | | | |
|---|---|---|---|---|
| 5,125,909 | A | 6/1992 | Heimberger | |
| 5,233,945 | A | 8/1993 | Wolf et al. | |
| 5,243,764 | A * | 9/1993 | Wieland | 30/383 |
| 5,305,800 | A | 4/1994 | Kolberg | |
| 5,324,557 | A | 6/1994 | Lupke | |
| 5,345,684 | A | 9/1994 | Shoup et al. | |
| 5,368,107 | A | 11/1994 | Taomo | |
| 5,383,427 | A | 1/1995 | Tuggle et al. | |
| 5,438,825 | A | 8/1995 | Bloemers | |
| 5,533,869 | A | 7/1996 | Garrison et al. | |
| 5,542,380 | A | 8/1996 | Chatten | |
| 5,727,506 | A | 3/1998 | Tajima et al. | |
| 5,857,327 | A | 1/1999 | Sato et al. | |
| 5,960,549 | A * | 10/1999 | Hoppner | 30/381 |
| 6,230,672 | B1 | 5/2001 | Ishibashi et al. | |
| 6,250,882 | B1 | 6/2001 | Nagashima | |
| 6,354,251 | B1 | 3/2002 | Toda | |
| 6,662,767 | B1 | 12/2003 | Nonaka | |
| 6,895,890 | B1 | 5/2005 | Maier, Jr. | |
| 6,973,726 | B2 | 12/2005 | Kramer | |
| 7,367,409 | B2 * | 5/2008 | Stones | 173/170 |
| 7,578,369 | B2 | 8/2009 | Francisco et al. | |
| 2002/0017331 | A1 | 2/2002 | Renaud | |
| 2002/0020370 | A1 | 2/2002 | Araki | |
| 2002/0104186 | A1 | 8/2002 | Miyamoto | |
| 2004/0172834 | A1 | 9/2004 | Ziegs et al. | |
| 2008/0092976 | A1 | 4/2008 | Nakazawa et al. | |
| 2009/0038106 | A1 | 2/2009 | Wada et al. | |
| 2009/0095269 | A1 | 4/2009 | Zama | |
| 2009/0100689 | A1 | 4/2009 | Shimokawa | |

FOREIGN PATENT DOCUMENTS

| | | | |
|---|---|---|---|
| JP | 53-8442 | U | 1/1978 |
| JP | 59-152159 | U | 10/1984 |
| JP | 60-49241 | U | 4/1985 |
| JP | 60-093126 | A | 5/1985 |
| JP | 63-158564 | U | 10/1988 |
| JP | 63-168225 | U | 11/1988 |
| JP | 63-285215 | A | 11/1988 |
| JP | 2-34725 | | 3/1990 |
| JP | 2-135613 | U | 11/1990 |
| JP | 3-58281 | B2 | 9/1991 |
| JP | 3-52981 | Y2 | 11/1991 |
| JP | 05-079494 | A | 3/1993 |
| JP | 5-33121 | B2 | 5/1993 |
| JP | 6-12882 | Y2 | 4/1994 |
| JP | 7-37769 | B2 | 4/1995 |
| JP | 9-144545 | A | 6/1997 |
| JP | 9-151739 | A | 6/1997 |
| JP | 10-052801 | A | 2/1998 |
| JP | 10-252565 | A | 9/1998 |
| JP | 2598703 | Y2 | 6/1999 |
| JP | 3029622 | B2 | 2/2000 |
| JP | 2000-310121 | A | 11/2000 |
| JP | 3167318 | B2 | 3/2001 |
| JP | 2001-140800 | A | 5/2001 |
| JP | 3186836 | B2 | 5/2001 |
| JP | 2001-193696 | A | 7/2001 |
| JP | 2002-54443 | A | 2/2002 |
| JP | 2002-332847 | A | 11/2002 |
| JP | 2003-097493 | A | 4/2003 |
| JP | 3594810 | B2 | 12/2004 |
| JP | 2005-233064 | A | 9/2005 |
| WO | 98/57053 | A1 | 12/1998 |

* cited by examiner

CHAINSAW

This application is a U.S. National Phase Application under 35 USC 371 of International Application PCT/JP2006/322717 filed Nov. 15, 2006.

TECHNICAL FIELD

The present invention relates to a chainsaw.

BACKGROUND ART

Chainsaws have been known as a cutter for cutting or pruning trees, bamboos and the like (for instance, see Patent Document 1).

A chainsaw described in Patent Document 1 includes: a saw chain; a body case accommodating an engine for driving the saw chain; and a handle held by an operator. The body case also accommodates a fuel tank, a cooling fan, an oil tank, a muffler and the like as well as the engine.

[Patent Document 1] JP-A-10-52801

DISCLOSURE OF THE INVENTION

Problems to be Solved by the Invention

Since the chainsaws are carried by an operator with hands when used for cutting, reduction in size and weight as well as improved operability of the chainsaws have been demanded.

An object of the present invention is to provide a downsized and light-weighted chainsaw with excellent operability.

Means for Solving the Problems

A chainsaw according to an aspect of the invention includes: a body case in which an engine for driving the chainsaw is accommodated; a top handle provided on an upper side of the body case; and a fuel tank for storing fuel of the engine, the fuel tank being integrally provided to the top handle.

In existing chainsaws, a fuel tank is generally provided as a part of a body case. Accordingly, the body case in the related art may be visually recognized large.

In contrast, according to the present invention, since the fuel tank is integrally provided with the top handle, the part of the body case can be slimmed as compared to the related art. Since the slimmed portion of the body case is easily viewable to an operator of the chainsaw, the operator can visually feel the chainsaw of the invention downsized.

The chainsaw may preferably further include: a carburetor provided in the top handle. The fuel tank may be preferably disposed near the carburetor.

In the arrangement, the carburetor and the fuel tank are disposed close to each other. Accordingly, in the chainsaw of the invention, piping to supply fuel from the fuel tank to the carburetor becomes extremely short. Hence, the size and weight of the chainsaw can be further reduced.

In the chainsaw, the top handle may be preferably coupled to the body case at least at three positions via an elastic member.

In the arrangement, since the body case is supported by the top handle via the elastic member, vibration of the top handle can be suppressed, so that the operator can hold the top hand more easily. Accordingly, the operability of the chainsaw can be enhanced. The fuel tank is heavy due to the amount of the fuel contained therein. Accordingly, by providing the heavy fuel tank on the top handle side, vibration of the body case can be considerably decreased. Hence, vibration reaching the top handle can be further reduced.

Further, since the body case is coupled to the top handle at least at three positions, the body case can comparatively stably support the top handle.

EXPLANATION OF CODES

Figure 1:
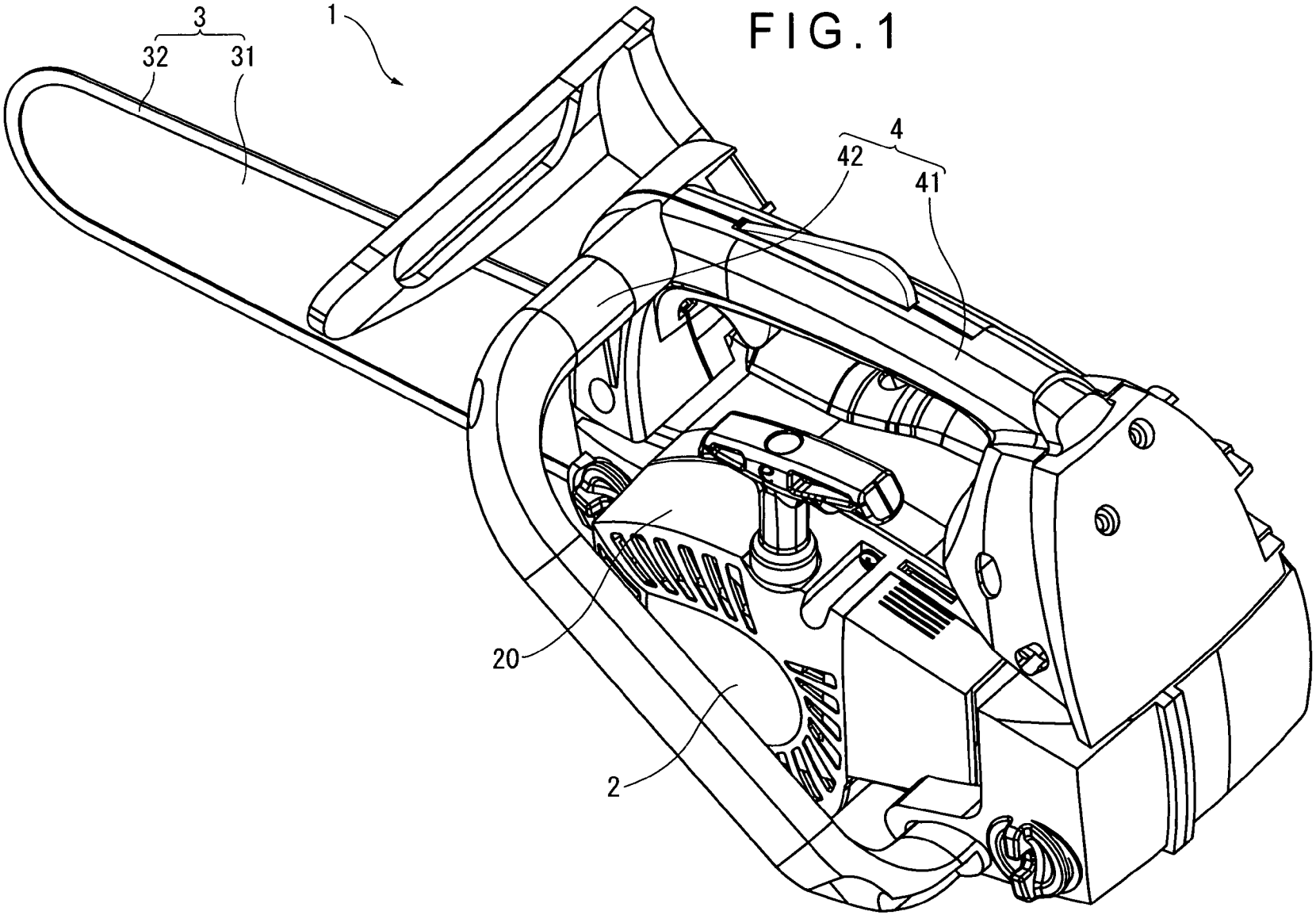
FIG. 1 is a perspective view showing an exterior of a chainsaw of an embodiment according to the present invention.

1: chainsaw
2: body
20: body case
221: plug cover
32: saw chain
4: handle section
5, 5A, 5B, 5C: connection spring
6: carburetor
7: fuel tank

BEST MODE FOR CARRYING OUT THE INVENTION

An embodiment of the present invention will be described below with reference to the drawings.

[Exterior of Chainsaw 1]

FIG. 1 is a perspective view showing an exterior of a chainsaw 1 of the embodiment.

Figure 2:
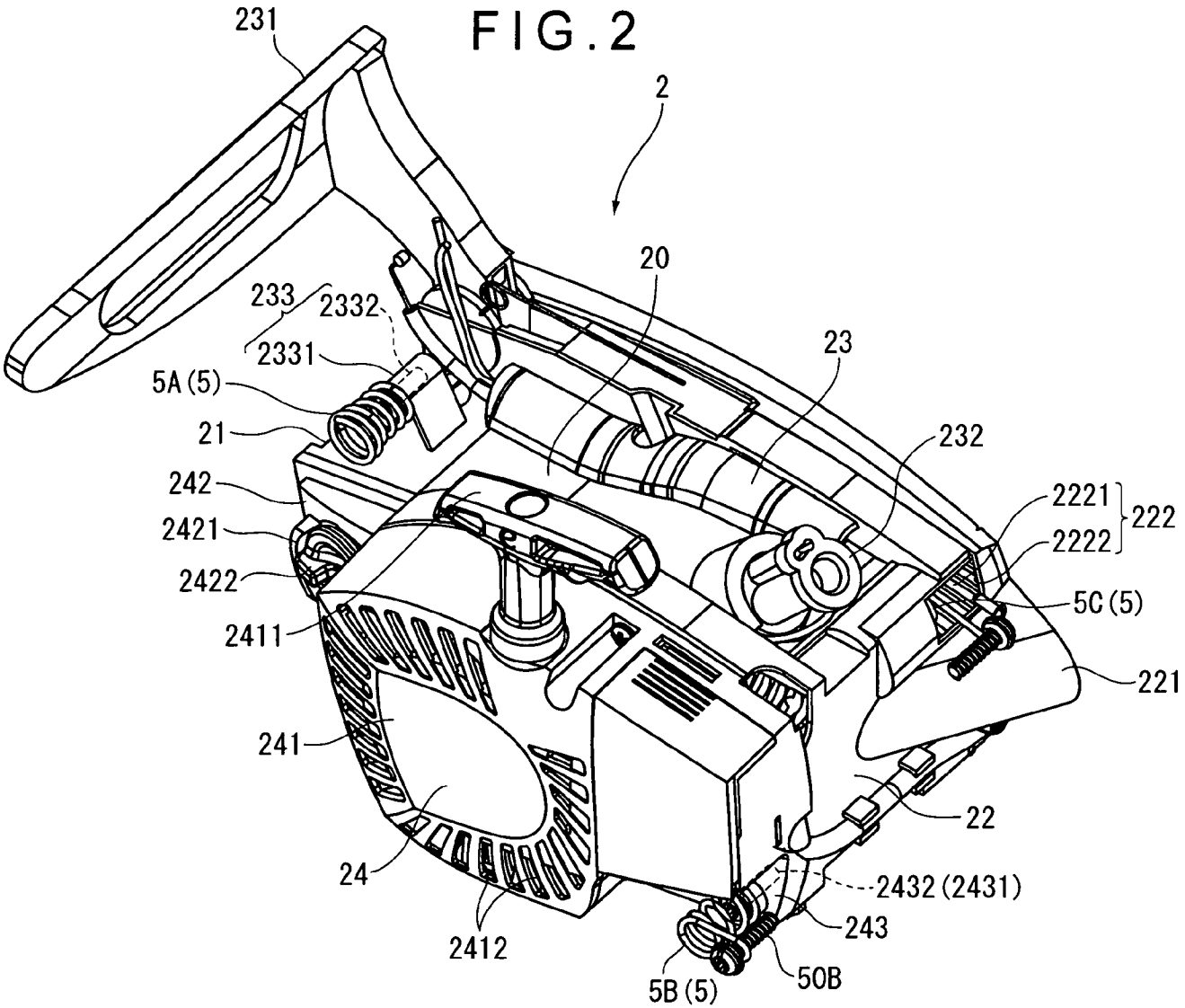
FIG. 2 is a perspective view showing an exterior of a body of the aforesaid embodiment.

As shown in FIG. 1, the chainsaw 1 includes: a body 2; a chain section 3 protruding from the body 2; a handle section 4; and connection springs 5 (FIG. 2).

In FIG. 1, a projecting direction of the chain section 3 is defined as a front/rear direction of the chainsaw 1; a direction extending up and down perpendicularly to the front/rear direction is defined as an up/down direction; and a direction extending from right to left perpendicularly to the front/rear direction is defined as a right/left direction.

The body 2 includes a body case 20, an engine accommodated in the body case 20, a cooling fan, an exhaust muffler, an oil tank and the like.

The chain section 3 includes a guide bar 31 and a saw chain 32.

The guide bar 31 extends forward from a right side of the body case 20. The saw chain 32 is wound around a circumference of the guide bar 31. The engine in the body case 20 rotates the saw chain 32 along the circumference of the guide bar 31 via a sprocket.

[Exterior of Body Case 20]

FIG. 2 is a perspective view showing an exterior of the body case 20.

A hand guard 231 and a top-handle attachment 233 are provided on a case upper surface 23 of the body case 20. An insulator 232 mounted on the engine in the body case 20 protrudes from an opening formed in the case upper surface 23.

The hand guard 231 protects the hands of an operator who holds the handle section 4 (FIG. 1) from the saw chain 32.

The insulator 232 supplies fuel/air-mixed gas from a below-described carburetor 6 (FIG. 5) in the handle section 4 to the engine in the body case 20. The insulator 232 insulates the carburetor 6 from engine heat. As shown in FIG. 2, the insulator 232 protrudes obliquely backward.

The top-handle attachment 233 includes an attachment projection 2331 protruding upward from a front end of the case upper surface 23. In a cylindrical portion provided in an end of the attachment projection 2331, a threaded hole 2332 is formed in the right/left direction. A first end of a connection spring 5A is fixed at the threaded hole 2332 with a screw.

A case left surface 24 includes an expanded portion 241, a front end 242 and a rear lower corner portion 243.

The expanded portion 241 has: a handle 2411 of a recoil starter to start the engine; and a plurality of suction holes 2412 through which air is sucked by the cooling fan.

On the front end 242, an oil supplier 2421 is provided. The oil supplier 2421 is in communication with the oil tank accommodated in the front end 242. Oil to lubricate the guide bar 31 and the saw chain 32 (FIG. 1) is supplied through the oil supplier 2421 to the oil tank. The oil supplier 2421 is sealed with a stopper 2422 when not supplying the oil. With the above-described arrangement, an oil supply passage from the oil supplier 2421 to the guide bar 31 and the saw chain 32 becomes the shortest, thereby securely reducing the size and the weight of the chainsaw 1.

On the rear lower corner portion 243, an attachment 2431 is provided. The attachment 2431 has a threaded hole 2432 extending in the right/left direction. A first end of a connection spring 5B is fixed at the threaded hole 2432 with a screw.

On a case rear surface 22, a plug cover 221 and an attachment 222 are provided.

The plug cover 221 covers a plug (not shown) attached on the engine. In the embodiment, the plug is provided in a posture where a rear portion of the plug is slanted rightward relative to the front/rear direction. Accordingly, the plug cover 221 gradually expands backward from a middle portion to a right end of the case rear surface 22 in accordance with the posture of the plug.

Thus, by shaping the plug cover 221 to fit an outer profile of the plug, space can be obtained on a rear side of the plug cover 221. This space is larger than that in the related art that has not been utilized and is sufficient to accommodate a below-described fuel tank 7.

The attachment 222 includes a hollow chamber 2221 and an opening 2222 formed on a rear wall of the hollow chamber. A threaded hole (not shown) is formed in the hollow chamber 2221.

A connection spring 5C is accommodated. A first end of the connection spring 5C is fixed at the threaded hole in the hollow chamber 2221 with a screw.

[Arrangement of Handle Section 4]

Figure 3:
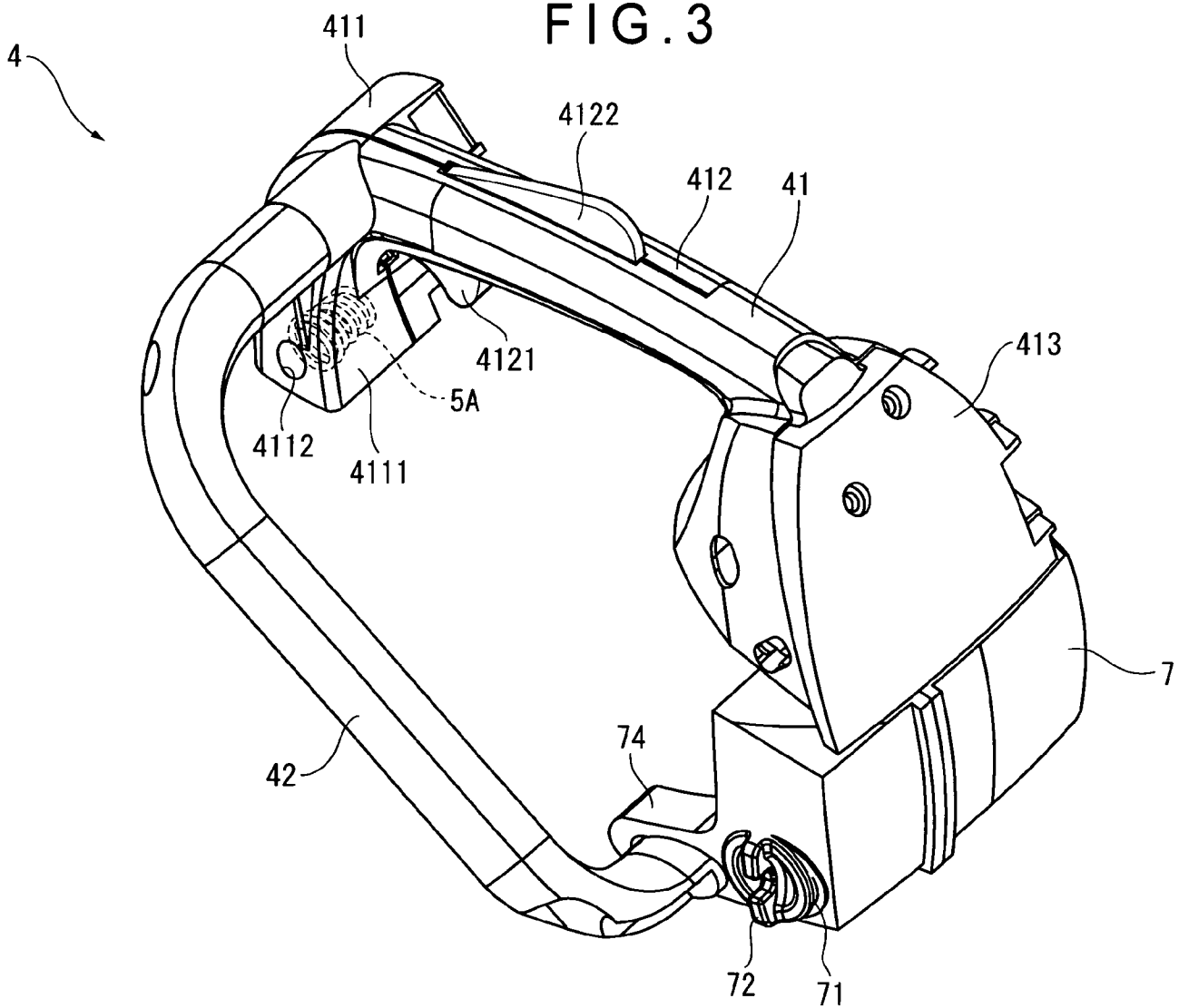
FIG. 3 is a perspective view showing an exterior of a handle section of the aforesaid embodiment.
Figure 4:
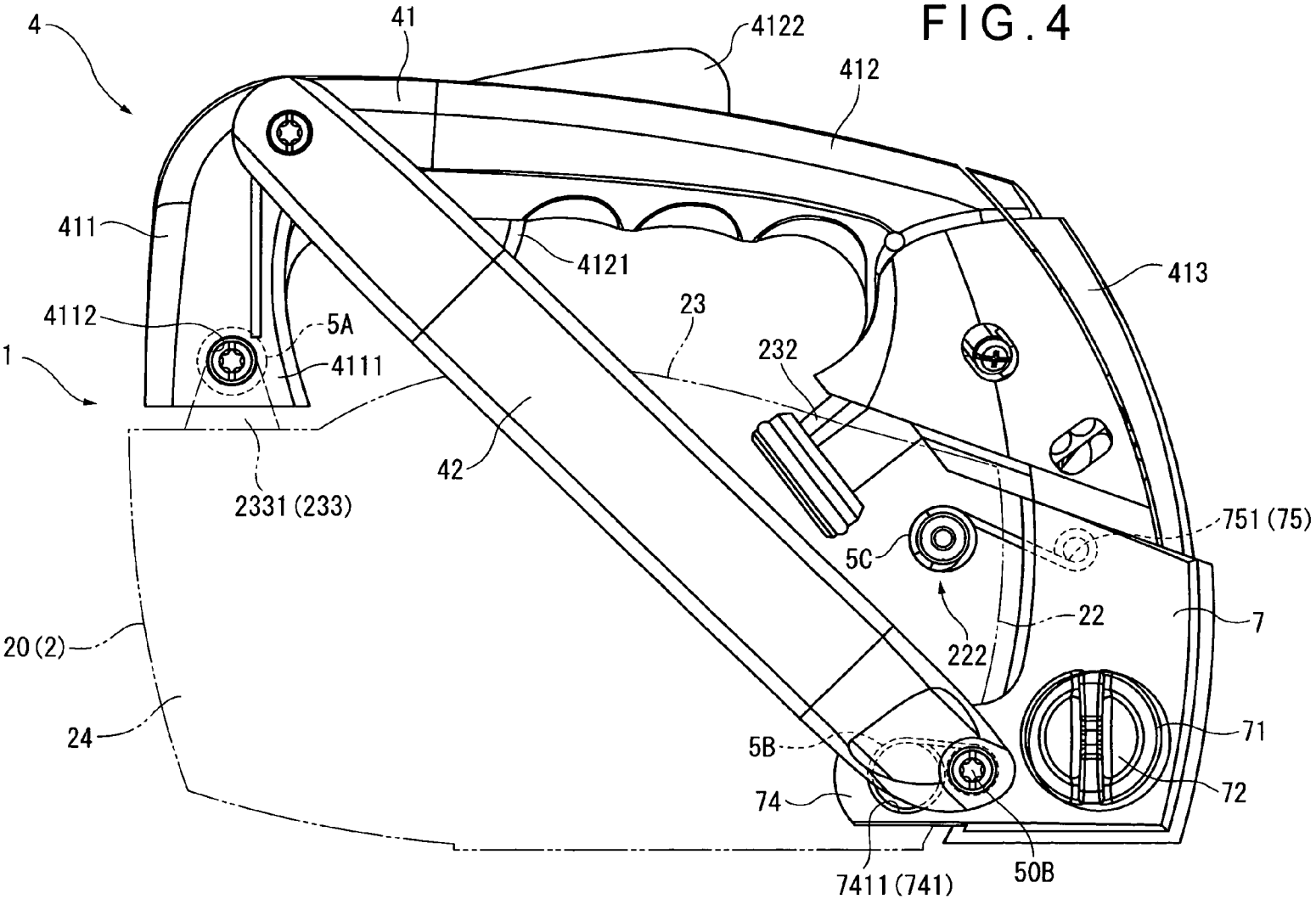
FIG. 4 is a side view showing the exterior of the handle section of the aforesaid embodiment.

FIG. 3 is a perspective view showing an arrangement of the handle section 4. FIG. 4 is a side view showing the arrangement of the handle section 4.

The handle section 4 is held by an operator when the chainsaw 1 is used. As shown in FIGS. 3 and 4, the handle section 4 includes a top handle 41 and a side handle 42.

Since the handle section 4 consists of the top handle 41 and the side handle 42, the strength of the handle section 4 can be increased. Since the strength of the entire handle section 4 is enhanced, the thicknesses of the top handle 41 and the side handle 42 can decreased. Thus, the handle section 4 and consequently the whole chainsaw 1 become lighter in weight.

The side handle 42 is held by an operator with one hand when the chainsaw 1 is used. As shown in FIG. 4, the side handle 42 obliquely extends from a top upper portion to a rear down portion of the chainsaw 1 along the case left surface 24. Upper and lower ends of the side handle 42 are fixed to the top handle 41 with a screw.

As shown in FIG. 4, the top handle 41 is substantially C-shaped extending along outer profiles of the case upper surface 23 and the case rear surface 22 of the body case 20. A front lower end and a rear lower end of the top handle 41 are coupled to the top-handle attachments 233, 2431, 222 (FIG. 2) of the body case 20 via the connection springs 5A to 5C. Connecting structures by the connection springs 5A to 5C will be described below.

The top handle 41 includes a support 411, a grip 412, a handle case 413 and the fuel tank 7.

The support 411 is hollowed and is provided with an attachment 4111 at a lower end. In the attachment 4111, a second end of the connection spring 5A is fixed. In the attachment 4111, a circular opening 4112 is provided at a position aligned with the center of the connection spring 5A.

The grip 412 extends from an upper portion to a rear portion of the support 411, which is held by an operator with the other hand when the chainsaw 1 is used. The grip 412 is provided with: a throttle lever 4121 for adjusting output of the engine; and a stopper lever 4122 for regulating operation of the throttle lever 4121.

The handle case 413 is provided on a rear lower side of the grip 412.

Figure 5:
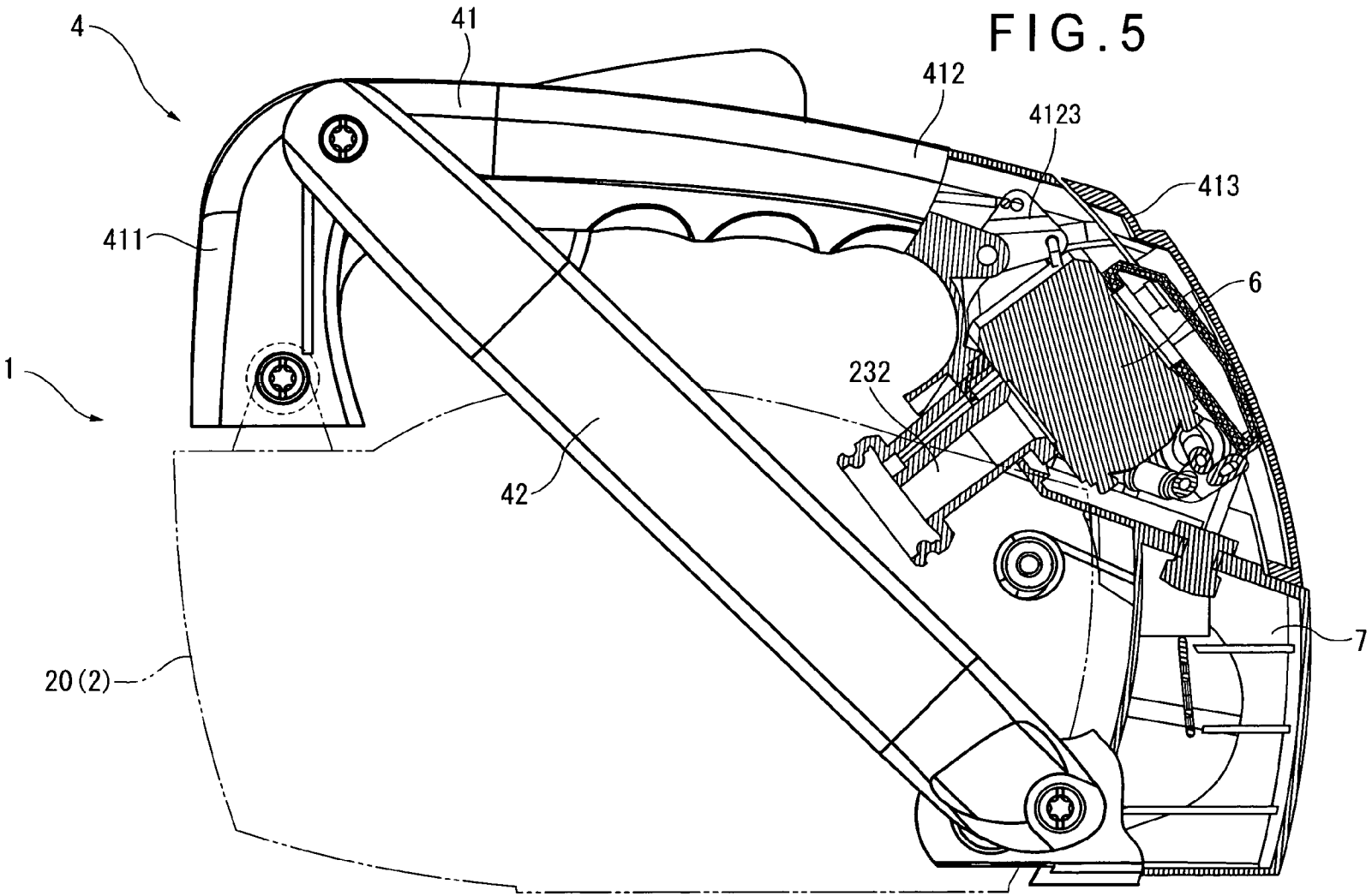
FIG. 5 is a cross section schematically showing an inner structure of the handle section of the aforesaid embodiment.

FIG. 5 is a cross section showing inner arrangements of the handle case 413 and the fuel tank 7.

In the handle case 413, the carburetor 6 is accommodated. The carburetor 6 is coupled with the insulator 232 protruding from the body case 20.

[Arrangement of Fuel Tank 7]

As shown in FIGS. 3 and 4, the fuel tank 7 is integrally provided under the handle case 413. When the fuel tank 7 is coupled to the attachments 2431, 222 of the body case 20 via the connection springs 5B and 5C, the handle case 413 is also attached to the body case 20 on a lower side.

Thus, since the fuel tank 7 is located near the carburetor 6, piping to deliver fuel from the fuel tank 7 to the carburetor 6 becomes short, thereby contributing to downsizing and weight reduction of the chainsaw 1.

Further, since the fuel tank 7 is located in the space below the handle case 413, which has not been used in the related art, the operator can visually feel the chainsaw 1 downsized.

The connecting structures with the connection springs 5 make vibration of the body case 20 less likely to reach the handle section 4. In addition, the heavy fuel tank 7 provided in the handle section 4 restrains vibration of the body case 20, thereby further reducing vibration transferred to the handle section 4.

As shown in FIGS. 3 and 4, on an outer side of the fuel tank 7, a fuel supplier 71, an extending piece 74 and an attachment 75 are provided.

The fuel supplier 71 is provided on a left surface of the fuel tank 7. Fuel is supplied through the fuel supplier 71 to the fuel tank 7. When the fuel is not supplied, the fuel supplier 71 is sealed by the stopper 72.

The extending piece 74 extends forward from a lower end of the left surface of the fuel tank 7. The extending piece 74 is coupled with the lower end of the side handle 42 and is provided with an attachment 741.

As shown in FIG. 4, the attachment 741 includes: a circular opening 7411 penetrating the extending piece 74 in the right/left direction; and a threaded hole (not shown) formed on a rear side of the circular opening 7411 to extend in the right/left direction. The connection spring 5B is inserted through the circular opening 7411. An end of the connection spring 5B extending backward is fixed at the threaded hole with a screw.

The attachment 75 includes a threaded hole 751 provided on a right surface of the fuel tank 7 to extend in the right/left direction. An end of the connection spring 5C extends backward to be fixed at the threaded hole 751 with a screw.

[Connecting Structure of Connecting Spring 5]

The connecting structure of the connection spring 5 will be described below with reference to FIGS. 1 to 5.

The connection springs 5 (5A, 5B and 5C) couple the body 2 and the handle section 4. Specifically, the body 2 is suspended from the handle section 4 at the three points of the upper front end, the rear left end and the rear right end on which the respective connection springs are attached.

The connection spring 5A couples the attachment 4111 of the top handle 41 and the top-handle attachment 233 of the body case 20. Specifically, the attachment 4111 is coupled with the top-handle attachment 233 disposed below the attachment 4111 with the attachment projection 2331 inserted upward into the hollow of the attachment 4111.

The connection spring 5A is accommodated in the attachment 4111. The left end of the connection spring 5A is fixed on an inner wall of the attachment 4111. On the other hand, the right end of the connection spring 5A is fixed at the threaded hole 2332 of the attachment projection 2331 with a screw. In assembling, a screw is inserted into the attachment 4111 from the circular opening 4112 to pass the axial center of the connection spring 5A and the right end is screwed into the threaded hole 2332. Thus, the screw is fixed in the top-handle attachment 233.

The connection spring 5B couples the attachment 741 of the top handle 41 and the attachment 2431 of the body case 20. Specifically, the attachment 741 is coupled on a left portion of the attachment 2431.

The connection spring 5B is inserted in the circular opening 7411 of the attachment 741. A first end of the connection spring 5B is fixed at the threaded hole 2432 of the attachment 2431 with a screw. On the other hand, a second end of the connection spring 5B extends backward as shown in FIG. 4 to be fixed at the through hole of the attachment 741 with a screw 50B.

The screw 50B is screwed by means of the threaded hole formed on the lower end of the side handle 42 on the left side of the attachment 741. When the screw 50B is screwed, the lower end of the side handle 42 is coupled to the lower end of the fuel tank 7 of the top handle 41.

As shown in FIG. 2, the connection spring 5C couples the attachment 75 of the top handle 41 and the attachment 222 of the body case 20. Specifically, the attachment 75 is provided on a rear portion of the attachment 222.

The connection spring 5C is provided in the hollow chamber 2221 of the attachment 222. A first end of the connection spring 5C is fixed at the threaded hole of the hollow chamber 2221 with a screw. As shown FIG. 4, a second end of the connection spring 5C extends backward to be fixed at the threaded hole 751 of the attachment 75 with a screw.

Thus, since the body 2 is suspended from the handle section 4 by means of the connection springs 5A to 5C, vibration of the body case 20 is less likely to be transferred to the handle section 4. Accordingly, vibration of the handle section 4 is suppressed, thereby allowing the operator to easily hold the handle section 4.

Note that, although the best arrangement to implement the invention has been disclosed above, the invention is not limited thereto. In other words, although the invention has been illustrated and described by exemplifying the specific embodiment, modifications or improvements made in shape, material, quantity and other details of the above-described embodiment are also contained in the technical idea and the scope of the invention.

For instance, the description limiting shape, material and the like is given as examples to facilitate understanding of the invention with no intention to restrict the invention. Hence, the invention also encompasses description using component names with a part of or all of limitation on the shape, material and the like removed.

Further, although the carburetor 6 is accommodated in the top handle 41 in the embodiment, the carburetor 6 may be accommodated in the body case 20 as long as the carburetor 6 is positioned in the vicinity of the fuel tank 7.

Although the connection spring 5 is employed as an elastic member in the embodiment, the elastic member may be any other component as long as the component is elastic and can securely support the body case 20 and the top handle 41.

Although the body case 20 is coupled with the handle section 4 at the three positions on the upper front end, the body case 20 may be coupled at any positions as long as the handle section 4 can securely hold the body 2. However, the body case 20 may be preferably coupled to the handle section 4 at least at three positions in order to be securely supported.

INDUSTRIAL APPLICABILITY

The present invention can be suitably applied to a small chainsaw.

The invention claimed is:

1. A chainsaw, comprising:

a guide bar around which a saw chain is wound, the guide bar extending in a front/rear direction of the chainsaw, an up/down direction of the chainsaw being defined as a direction which is set within an imaginary plane including a rotational plane in which the saw chain is rotated and which is orthogonal to the front/rear direction, and a right/left direction of the chainsaw being defined as a direction that is orthogonal to the front/rear direction and to the up/down direction;

a body case in which an engine for driving the saw chain is accommodated;

a top handle provided on an upper side of the body case and extending along the front/rear direction, the top handle being provided with a throttle lever for adjusting an output of the engine; and a fuel tank for storing fuel for the engine, the fuel tank being integrally provided to the top handle, wherein the top handle is coupled to the body case via at least one elastic member.

2. The chainsaw according to claim 1, further comprising:

a carburetor provided in the top handle, wherein the fuel tank is disposed near the carburetor.

3. The chainsaw according to claim 1, wherein the top handle is coupled to the body case via elastic members at least at three positions.

4. The chainsaw according to claim 2, wherein the top handle is coupled to the body case via elastic members at least at three positions.

* * * * *